US009337587B2

(12) United States Patent
Hsu

(10) Patent No.: US 9,337,587 B2
(45) Date of Patent: May 10, 2016

(54) ELECTRICAL CONNECTORS

(71) Applicant: Yong Tai Electronic (DONG GUAN) Ltd., Dongguan (CN)

(72) Inventor: Ching-Jen Hsu, Dongguan (CN)

(73) Assignee: Yong Tai Electronic (Dong Guan) Ltd., Dongguan (CN)

( * ) Notice: Subject to any disclaimer, the term of this patent is extended or adjusted under 35 U.S.C. 154(b) by 13 days.

(21) Appl. No.: 14/340,399

(22) Filed: Jul. 24, 2014

(65) Prior Publication Data

US 2014/0335719 A1 Nov. 13, 2014

Related U.S. Application Data

(63) Continuation-in-part of application No. 14/313,844, filed on Jun. 24, 2014, now Pat. No. 9,028,268, which is a continuation of application No. 13/439,201, filed on Apr. 4, 2012, now Pat. No. 8,794,992.

(30) Foreign Application Priority Data

Jul. 24, 2013 (CN) ..... 2013 2 0443830

(51) Int. Cl.

| | |
|---|---|
| ***H01R 13/627*** | (2006.01) |
| ***H01R 13/6582*** | (2011.01) |
| ***H01R 13/6598*** | (2011.01) |
| ***H01R 13/6593*** | (2011.01) |

(52) U.S. Cl.

CPC ..... *H01R 13/6582* (2013.01); *H01R 13/6593* (2013.01); *H01R 13/6598* (2013.01)

(58) Field of Classification Search

CPC ..... H01R 13/5213; H01R 13/6593; H01R 13/6582; H01R 13/6598

USPC ..... 439/353, 492, 499, 607.54–607.56, 660

See application file for complete search history.

(56) References Cited

U.S. PATENT DOCUMENTS

| | | | |
|---|---|---|---|
| 7,033,218 | B2 | 4/2006 | Huang et al. |
| 7,198,522 | B1 | 4/2007 | Ho et al. |
| 8,197,281 | B2 | 6/2012 | Yang |

*Primary Examiner* — Khiem Nguyen

(74) *Attorney, Agent, or Firm* — Edward C. Kwok; Steven P. Chen; Hogan Lovells US LLP

(57) ABSTRACT

The present invention discloses an electrical connector that includes a front zinc-alloy shell and a rear zinc-alloy shell. The front zinc-alloy shell and the rear zinc-alloy shell are made from die casting. The two shells are fitted tightly to provide shielding against electromagnetic interference. There is a cable plastic block with holding grooves to hold wires for electrical grounding and an isolation plate underneath the cable to provide electrical isolation. The holding grooves increase the connection strength of a connector cable. There is also a plastic block with an engagement hook. The engagement hook has a hook portion at one end and a curved fixing portion at the other end with an extending portion. The engagement hook provides an elastically supportive force. When a downward force is applied to the engagement hook, the curved fixing portion provides a counteracting force to press the extension portion against the front zinc-alloy shell.

19 Claims, 5 Drawing Sheets

ELECTRICAL CONNECTORS

CROSS REFERENCE TO RELATED APPLICATIONS

The present application is a continuation-in-part of U.S. patent application Ser. No. 14/313,844 filed on Jun. 24, 2014, which is a continuation application of U.S. patent application Ser. No. 13/439,201 filed on Apr. 4, 2012. The present application also claims priority, under the Paris Convention, to Chinese patent application, application number 201320443830.2, filed on Jul. 24, 2013, in the Intellectual Property Office of the People's Republic of China. The disclosures of the U.S. applications and the disclosure of the Chinese application are hereby incorporated by reference in their entirety.

BACKGROUND OF THE INVENTION

1. Field of the Invention

The present invention relates to technology for electrical connectors and, in particular, to technology for Universal Serial Bus (USB), Mobile High-Definition Link (MHL), or High Definition Multimedia Interface (HDMI) connectors.

2. Description of Related Art

The rapid development of computer hardware has brought about a proliferation of computer peripheral devices, such as the keyboard, mouse, modem, printer, scanner, digital camera, and MP3 player. These peripheral devises may connect to a computer through interfaces such as the USB, MHL or HDMI and may have a USB, MHL or HDMI connector that a user may insert into a USB, MHL or HDMI socket on the computer to make the connection. Conventional USB, MHL or HDMI connectors have several shortcomings.

For example, a conventional USB, MHL or HDMI connector has a front zinc-alloy shell and a mating rear zinc-alloy shell. The front zinc-alloy shell and the rear zinc-alloy shell are conventionally made by sheet metal stamping. When the two shells are mated, a tight fit may not form between them, leading to poor shielding against electromagnetic interference (EMI) and degradation in the noise immunity of the USB, MHL or HDMI connector.

In addition, a conventional USB, MHL or HDMI connector employs a hook, which is elastically deformed under an external force, to attach the USB, MHL or HDMI connector to the socket and to prevent the USB, MHL or HDMI connector from becoming detached from the socket. However, due to the inadequate force of the hook, it is relatively easy for the USB, MHL or HDMI connector to inadvertently detach from the socket.

Furthermore, in a conventional USB, MHL or HDMI connector, a cable plastic block is wrapped in an inner membrane, and the inner membrane is wrapped in the rear zinc-alloy shell. A rear plastic block and the cable plastic block are held together using two engagement elements that extend from behind the rear plastic block to connect to the rear zinc-alloy shell. There is a gap between the rear plastic block and the cable plastic block. Because there is no contact between the rear zinc-alloy shell and the rear plastic block and because of the gap between the rear plastic block and the cable plastic block, when the USB, MHL or HDMI connector is inserted into the socket, it is easy for the rear plastic block to be pushed back.

Furthermore, electrical grounding of the USB, MHL or HDMI connector is conventionally achieved by selecting one or more braided wires from the cable and attaching the braided wires to a rear portion of the rear zinc-alloy shell through clamping or other mechanisms. As such, the braided wires may not be resistant to the pulling force applied when the USB, MHL or HDMI connector is inserted or removed from the socket, causing the USB, MHL or HDMI connector to fail the reliability requirement of a high stress test.

Finally, the electrical wires of the cable may unravel such that they make contact with the rear zinc-alloy shell. When the rear zinc-alloy shell is soldered during assembly, the electrical wires may be burned, causing short circuits.

As such, it is desirable to provide an improved USB, MHL or HDMI connector that solves the shortcomings of the conventional structure, thereby increasing the reliability of the USB, MHL or HDMI connection.

SUMMARY OF THE INVENTION

An objective of the present invention is to provide a USB, MHL or HDMI connector that provides good shielding against EMI. Another objective of the present invention is to provide a USB, MHL or HDMI connector that does not become easily detached from a USB, MHL or HDMI socket, and whose rear plastic block is not pushed back when the USB, MHL or HDMI connector is inserted into the socket. Another objective of the present invention is to provide a USB, MHL or HDMI connector with a solid electrical grounding that is resistant to the pulling force applied when the USB, MHL or HDMI connector is inserted into or detached from the socket. Another objective of the present invention is to provide a USB, MHL or HDMI connector that prevents short circuits when the rear zinc-alloy shell of the USB, MHL or HDMI connector is soldered.

Disclosed is a USB, MHL or HDMI connector that achieves the above objective. The embodiments of the present invention are described in reference to a USB connector. However, it is understood the present invention may be embodied in a MHL, HDMI, or other types of connectors. In one embodiment of the present invention, the USB connector includes a primary assembly. The primary assembly includes a front plastic block and a front zinc-alloy shell that encases a rear portion of the front plastic block. The front plastic block is provided with an engagement hook that provides the USB connector with an elastically supportive force when the USB connector is inserted into a USB socket. The engagement hook has a hook portion, an elongated arm, and a curved fixing portion. The hook portion is located at one end of the elongated arm, and the curved fixing portion is located at another end of the elongated arm. When a downward force is applied to the engagement hook, the curved fixing portion provides a counteracting force to affix the engagement hook onto the front plastic block. The curved fixing portion of the engagement hook also has an extending portion that counters the force applied to the engagement hook. The top of the extending portion presses against an inner surface of the front zinc-alloy shell through a notch in the front plastic block.

In one embodiment of the present invention, the primary assembly further includes electrical terminal pins, a rear plastic block to accommodate the soldering ends of the electrical terminal pins, a cable plastic block to accommodate a cable, an inner membrane, and a rear zinc-alloy shell. The rear plastic block is fitted to a rear end of the front plastic block. The cable plastic block is fitted to a rear end of the rear plastic block. One end of the cable is placed at the soldering ends of the electrical terminal pins. The cable plastic block is wrapped in the inner membrane, and the inner membrane is encased in the rear zinc-alloy shell. The rear zinc-alloy shell has an extension bar which presses against the rear end of the rear plastic block.

In one embodiment of the present invention, the rear zinc-alloy shell has two extension bars that press against the rear end of the rear plastic block. The two extension bars may be on the same side of the rear zinc-alloy shell.

In one embodiment of the present invention, the cable plastic block has two holding grooves, one on each lateral side, for holding the braided wires of the cable. The braided wires held in the holding grooves may be connected to the front zinc-alloy shell or the rear zinc-alloy shell to provide electrical grounding to the USB connector. In one embodiment of the present invention, the cable plastic block has an isolation plate underneath the cable.

In one embodiment of the present invention, the front zinc-alloy shell and the rear zinc-alloy shell are made by die-casting. When the front zinc-alloy shell and the rear zinc-alloy shell are mated, they form a tight seal to provide good shielding against EMI. In one embodiment of the prevent invention, the front zinc-alloy shell and the rear zinc-alloy shell are both thin-walled castings that have a thickness of less than 0.5 mm.

A USB connector according to one embodiment of the present invention includes a primary assembly. The primary assembly includes a front plastic block and a front zinc-alloy shell that encases a rear portion of the front plastic block. The front plastic block is provided with an engagement hook that provides the USB connector with an elastically supportive force when the USB connector is inserted into a USB socket. The curved fixing portion of the engagement hook has an extending portion that counters the force applied to the engagement hook. The top of the extending portion presses against an inner surface of the front zinc-alloy shell, thereby increasing the supportive force provided by the engagement hook. Thus, the engagement hook solves the problem of a conventional USB connector inadvertently detaching from a USB socket due to the inadequate force of its hook. The rear zinc-alloy shell has two extension bars which press against the rear end of the rear plastic block, thereby preventing the rear plastic block from being pushed back when the USB connector is inserted into a USB socket. The cable plastic block has two holding grooves, one on each lateral side. The holding grooves serve as a strain release to relieve some of the tensile stress on the braided wires of the cable, thereby increasing the connection strength of the cable and allowing the USB connector to meet the reliability requirement of a high stress test. As mentioned, the unraveled electrical wires of the cable in the cable plastic block may come into contact with the rear zinc-alloy shell. The thin membrane may only stabilize the cable and may not prevent the cable from being burned and becoming electrically shorted when the rear zinc-alloy shell is soldered. The isolation plate protects the cable from being burned when the rear zinc-alloy shell is soldered, thus solving the short-circuit problem. The front zinc-alloy shell and the rear zinc-alloy shell are made by die-casting to have tight tolerances. When the front zinc-alloy shell and the rear zinc-alloy shell are mated, they form a tight seal to provide good shielding against EMI. The front zinc-alloy shell and the rear zinc-alloy shell may be made by thin-walled die-casting to have a thickness of less than 0.5 mm.

BRIEF DESCRIPTION OF THE DRAWINGS

The accompanying drawings are provided together with the following description of the embodiments for a better comprehension of the present invention. The drawings and the embodiments are illustrative of the present invention, and are not intended to limit the scope of the present invention. It is understood that a person of ordinary skill in the art may modify the drawings to generate drawings of other embodiments that would still fall within the scope of the present invention.

In FIG. 1 through FIG. 6, the reference numerals include: 1—engagement hook, 11—hook portion, 12—elongated arm, 13—curved fixing portion, 131—extending portion, 2—front plastic block, 3—front zinc-alloy shell, 4—rear zinc-alloy shell, 41—extension bar, 5—rear plastic block, 6—cable plastic block, 61—holding grooves, 62—isolation plate, 7—front metal shell, 8—inner membrane, 9—cable, 91—braided wires, and 10—electrical terminal pins.

DETAILED DESCRIPTION

Figure 1:
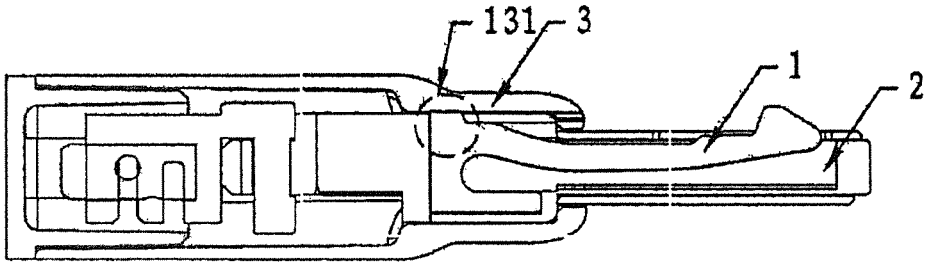
FIG. 1 shows a cross-sectional view of a USB connector according to one embodiment of the present invention.

The following paragraphs describe several embodiments of the present invention in conjunction with the accompanying drawings. It should be understood that the embodiments are used only to illustrate and describe the present invention, and are not to be interpreted as limiting the scope of the present invention.

FIG. 1 through FIG. 6 show a USB connector according to one embodiment of the present invention. The USB connector includes a primary assembly. The primary assembly includes a front plastic block 2 and a front zinc-alloy shell 3 that encases a rear portion of the front plastic block 2. The front plastic block 2 is provided with an engagement hook 1 that provides the USB connector with an elastically supportive force when the USB connector is inserted into a USB socket. The engagement hook 1 has a hook portion 11, an elongated arm 12, and a curved fixing portion 13. The hook portion 11 is located at one end of the elongated arm 12, and the curved fixing portion 13 is located at another end of the elongated arm 12. When a downward force is applied to the engagement hook 1, the curved fixing portion 13 provides a counteracting force to affix the engagement hook 1 onto the front plastic block 2.

Figure 2:
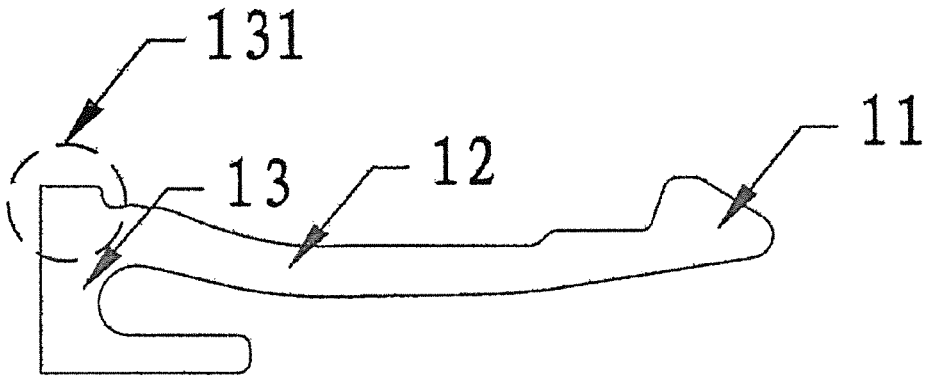
FIG. 2 shows a schematic view of an engagement hook of FIG. 1 according to one embodiment of the present invention.

As shown in FIGS. 1 and 2, the curved fixing portion 131 of the engagement hook 1 has an extending portion 131 that counters the force applied to the engagement hook 1. The top of the extending portion 131 presses against an inner surface of the front zinc-alloy shell 3. The front plastic block 2 has a notch to accommodate the extending portion 131. Pressing the top of the extending portion 131 against the inner surface of the front zinc-alloy shell 3 increases the elastically supportive force of the engagement hook 1. Thus, the engagement hook 1 solves the problem of a conventional USB connector inadvertently detaching from a USB socket due to the inadequate force of its hook.

In one embodiment of the present invention, the primary assembly further includes electrical terminal pins 10, a rear plastic block 5 to accommodate the soldering ends of the electrical terminal pins 10, a cable plastic block 6 to accommodate a cable 9, an inner membrane 8, and a rear zinc-alloy shell 4. The rear plastic block 5 is fitted to a rear end of the front plastic block 2. The cable plastic block 6 is fitted to a rear end of the rear plastic block 5. One end of the cable 9 is placed at the soldering ends of the electrical terminal pins 10. The cable plastic block 6 is wrapped in the inner membrane 8, and the inner membrane 8 is encased in the rear zinc-alloy shell 4.

Figure 3:
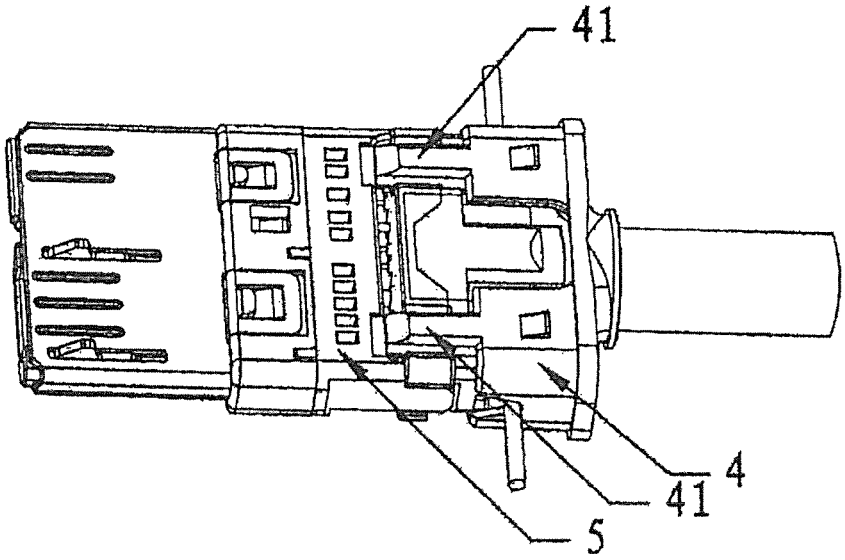
FIG. 3 shows a schematic view of the USB connector according to one embodiment of the present invention.

Referring to FIG. 3, the rear zinc-alloy shell 4 has at least one extension bar 41 which presses against the rear end of the rear plastic block 5. Pressing the extension bar 41 against the rear end of the rear plastic block 5 prevents the real plastic block 5 from being pushed back when the USB connector is inserted into a USB socket.

As shown in FIG. 3, the rear zinc-alloy shell 4 has two extension bars 41 which press against the rear end of the rear plastic block 5. The rear zinc-alloy shell 4 with two extension bars 41 may exert a more balanced force on the rear plastic block 5. In other embodiments of the present invention, the number of the extension bars 41 may be determined according to the practical requirement. As shown, the two extension bars 41 are on the same side of the rear zinc-alloy shell 4. Of course, the two extension bars 41 may also be on the two opposing sides of the rear zinc-alloy shell 4.

Figure 4:
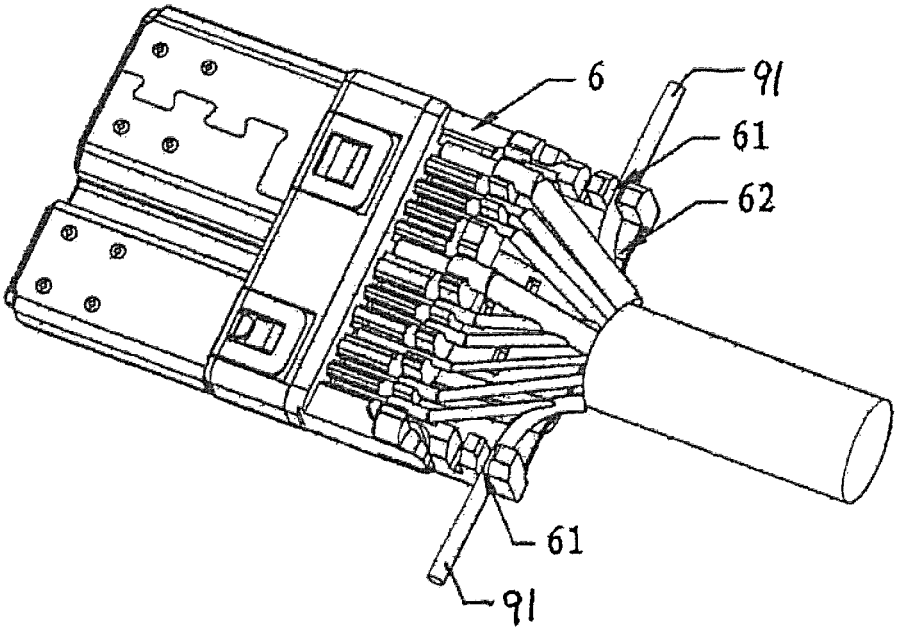
FIG. 4 shows another schematic view of the USB connector according to one embodiment of the present invention.
Figure 5:
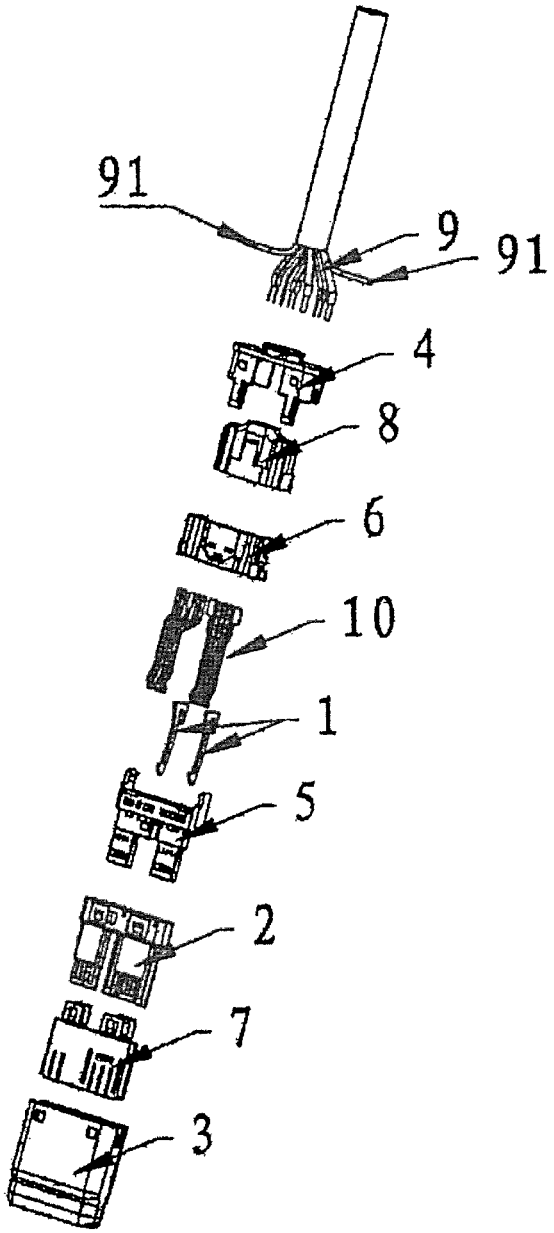
FIG. 5 shows an exploded view of the USB connector according to one embodiment of the present invention.

As shown in FIG. 4, the cable plastic block 6 has two holding grooves 61, one on each lateral side, for holding the braided wires 91 of the cable 9. Generally, electrical grounding of the USB connector is achieved by selecting one or more braided wires 91 from the cable 9, bending them backward, and attaching the braided wires 91 to a rear portion of the rear zinc-alloy shell 4 through clamping or other mechanisms. As such, the braided wires are directly subject to a pulling force when the USB connector is inserted into or removed from the socket, decreasing the connection strength of the cable 9 and causing the USB connector to fail the reliability requirement of a high stress test. To overcome the shortcomings of the conventional USB connector, embodiments of the present invention allow the braided wires 91 to be held in the holding grooves 61. As such, when the braided wires 91 are subject to a pulling force, the holding grooves 61 may serve as a strain release to relieve some of the tensile stress on the braided wires 91, thereby increasing the connection strength of the cable. The braided wires 91 may be connected to the front zinc-alloy shell 3 or the rear zinc-alloy shell 4 to provide electrical grounding for the USB connector.

As also shown in FIG. 4, the cable plastic block 6 has an isolation plate 62 provided under the cable 9. The isolation plate 62 protects the cable 9 from being burned when the rear zinc-alloy shell 4 is soldered. The isolation plate 61 thus solves the short-circuit problem of the conventional USB connector where the unraveled electrical wires of the cable 9 may make contact with the rear zinc-alloy shell 4 when the rear zinc-alloy shell 4 is soldered.

Figure 6:
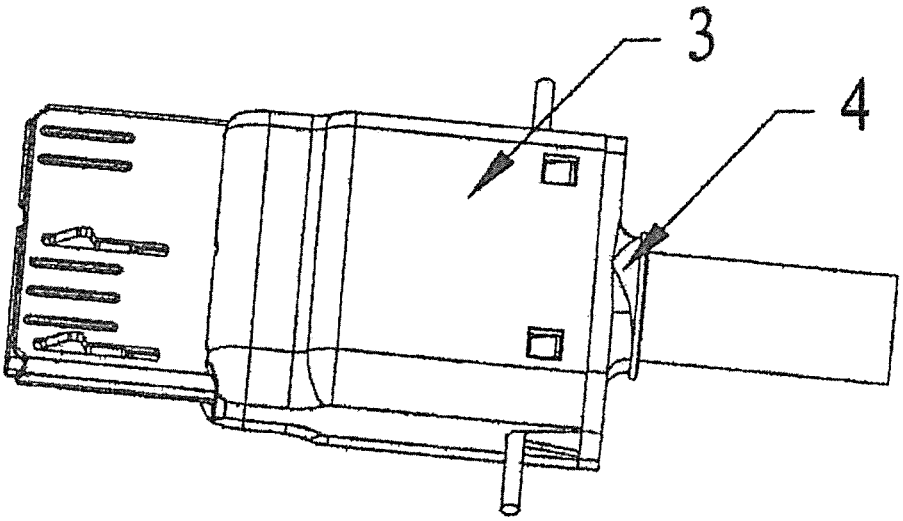
FIG. 6 shows an integrated view of the USB connector according to one embodiment of the present invention.

The front zinc-alloy shell 3 and the rear zinc-alloy shell 4 are made by die-casting to have tight tolerances. In one embodiment of the present invention, the front zinc-alloy shell 3 and the rear zinc-alloy shell 4 may be made by thin-walled die-casting to have a thickness of less than 0.5 mm. As shown in FIG. 6, the front zinc-alloy shell 3 and the rear zinc-alloy shell 4 are fitted and sealed tightly to provide good shielding against EMI for the USB connector. In other embodiments of the present invention, the front zinc-alloy shell 3 and the rear zinc-alloy shell 4 made by die-casting may be used on the MHL, HDMI, or other types of connectors to form a tight seal to shield against EMI. In other embodiments of the present invention, the front zinc-alloy shell 3 and the rear zinc-alloy shell 4 made by die-casting may be used on a receptacle or a socket rather than a plug of an electrical connector.

According to one embodiment of the present invention, the curved fixing portion 13 of the engagement hook 1 has an extending portion 131 that counters the force applied to the engagement hook 1. The top of the extending portion 131 presses against an inner surface of the front zinc-alloy shell 3, thereby increasing the elastically supportive force of the engagement hook 1. Thus, the engagement hook 1 solves the problem of a conventional USB connector inadvertently detaching from a USB socket due to the inadequate force of its hook. In addition, the rear zinc-alloy shell 4 has two extension bars 41 which press against the rear end of the rear plastic block 5, thereby preventing the rear plastic block 5 from being pushed back when the USB connector is inserted into a USB socket. Furthermore, the cable plastic block 6 has two holding grooves 61, one on each lateral side, for holding the braided wires 91 of the cable 9. The braided wires 91 may be connected to the front zinc-alloy shell 3 or the rear zinc-alloy shell 4 to provide electrical grounding for the USB connector. The holding grooves 61 may serve as a strain release to relieve some of the tensile stress on the braided wires 91, thereby increasing the connection strength of the cable 9 and allowing the USB connector to meet the reliability requirement of a high stress test. Furthermore, the isolation plate 62 may protect the cable 9 from being burned when the rear zinc-alloy shell 4 is soldered. As mentioned, the unraveled electrical wires of the cable 9 may make contact with the rear zinc-alloy shell 4. The thin membrane 8 may only stabilize the cable 9 and may not prevent the cable 9 from being burned and becoming electrically shorted when the rear zinc-alloy shell 4 is soldered. Thus, the isolation plate 62 solves the short-circuit problem of the conventional USB connector. The front zinc-alloy shell 3 and the rear zinc-alloy shell 4 may be made by die-casting to have tight tolerances. The front zinc-alloy shell 3 and the rear zinc-alloy shell 4 may be fitted and sealed tightly to provide good shielding against EMI for the USB connector.

The descriptions set forth above are provided to illustrate one or more embodiments of the present invention and are not intended to limit the scope of the present invention. Although the invention is described in details with reference to the embodiments, a person skilled in the art may obtain other embodiments of the invention through modification of the disclosed embodiment or replacement of equivalent parts. It is understood that any modification, replacement of equivalent parts and improvement are within the scope of the present invention and do not depart from the spirit and principle of the invention as hereinafter claimed.

What is claimed is:

1. An electrical connector, comprising:

a front zinc-alloy shell that is made from die-casting;

a rear zinc-alloy shell that is made from die-casting, wherein the front zinc-alloy shell and the rear zinc-alloy shell are fitted tightly to provide shielding against electromagnetic interference;

a cable of electrical wires; and a cable plastic block that has one or more holding grooves, wherein the holding grooves are configured to hold one or more of the electrical wires, and wherein the electrical wires held in the holding grooves are connected to the front zinc-alloy shell or the rear zinc-alloy shell to provide electrical grounding for the electrical connector.

2. The electrical connector of claim 1, wherein the cable plastic block has an isolation plate underneath the cable of electrical wires, wherein the isolation plate provides electrical isolation of the electrical wires from the front zinc-alloy shell or the rear zinc-alloy shell.

3. The electrical connector of claim 1, wherein the cable plastic block has two holding grooves, one on each lateral side of the cable plastic block, wherein each holding groove is configured to hold one of the electrical wires to provide the electrical grounding.

4. The electrical connector of claim 1, wherein the electrical wires are braided electrical wires.

5. The electrical connector of claim 1, wherein the electrical connector is a Universal Serial Bus (USB) connector, a Mobile High-Definition Link (MHL) connector, or a High Definition Multimedia Interface (HDMI) connector.

6. The electrical connector of claim 1, wherein the front zinc-alloy shell and the rear zinc-alloy shell are made from thin-walled die-casting to have a thickness of less than 0.5 mm.

7. An electrical connector, comprising:

a front plastic block, wherein the front plastic block provides an engagement hook that includes an elongated arm, a hook portion at one end of the elongated arm, a curved fixing portion at another end of the elongated arm, and an extending portion on the curved fixing portion; and a front metal alloy shell, wherein the front metal alloy shell encases a portion of the front plastic block, wherein the engagement hook provides the electrical connector with an elastically supportive force when the electrical connector is inserted into a socket such that when a downward force is applied to the engagement hook, the curved fixing portion provides a counteracting force to press the extension portion against an inner surface of the front metal alloy shell.

8. The electrical connector of claim 7, wherein the front plastic block has a notch to allow the extension portion to press against the inner surface of the front metal alloy shell.

9. The electrical connector claim of 8, wherein a top of the extension portion presses against the inner surface of the front metal alloy shell through the notch.

10. The electrical connector of claim 7, wherein the front metal alloy shell is a front zinc-alloy shell.

11. The electrical connector of claim 10, further comprising a rear zinc-alloy shell, wherein the front zinc-alloy shell is made from die-casting, the rear zinc-alloy shell is made from die-casting, and wherein the front zinc-alloy shell and the rear zinc-alloy shell are fitted tightly to provide shielding against electromagnetic interference.

12. The electrical connector of claim 7, wherein the electrical connector is a Universal Serial Bus (USB) connector, a Mobile High-Definition Link (MHL) connector, or a High Definition Multimedia Interface (HDMI) connector.

13. An electrical connector, comprising:

electrical terminal pins;

a rear plastic block configured to accommodate the electrical terminal pins;

a cable plastic block configured to accommodate a cable of electrical wires, wherein one end of the electrical wires in the cable is placed at the electrical terminal pins, and wherein the cable plastic block is fitted to a rear end of the rear plastic block; and a rear metal-alloy shell that has an extension bar, wherein the extension bar presses against the rear end of the rear plastic block.

14. The electrical connector of claim 13, wherein the rear metal-alloy shell has two extension bars that press against the rear end of the rear plastic block.

15. The electrical connector of claim 14, wherein the two extension bars are on a same side of the rear metal-alloy shell.

16. The electrical connector of claim 13, further comprising an inner membrane that wraps around the cable plastic block, wherein the inner membrane is encased in the rear metal-alloy shell.

17. The electrical connector of claim 13, further comprising a front plastic block, wherein the rear plastic block is fitted to a rear end of the front plastic block.

18. The electrical connector of claim 17, wherein the extension bar prevents the rear plastic block from being pushed back when the front plastic block of the electrical connector is inserted into a socket.

19. The electrical connector of claim 13, further comprising a front metal-alloy shell, wherein the front metal-alloy shell is made from die-casting, the rear metal-alloy shell is made from die-casting, and wherein the front metal alloy shell and the rear metal alloy shell are fitted tightly to provide shielding against electromagnetic interference.

* * * * *